US009113763B2

(12) United States Patent
Porter

(10) Patent No.: US 9,113,763 B2
(45) Date of Patent: Aug. 25, 2015

(54) VACUUM EXTENSION

(71) Applicant: Michael L. Porter, Englewood, FL (US)

(72) Inventor: Michael L. Porter, Englewood, FL (US)

( * ) Notice: Subject to any disclaimer, the term of this patent is extended or adjusted under 35 U.S.C. 154(b) by 36 days.

(21) Appl. No.: 13/868,633

(22) Filed: Apr. 23, 2013

(65) Prior Publication Data

US 2013/0283564 A1 Oct. 31, 2013

Related U.S. Application Data

(60) Provisional application No. 61/638,575, filed on Apr. 26, 2012.

(51) Int. Cl.
*A47L 9/02* (2006.01)

(52) U.S. Cl.
CPC ..... *A47L 9/02* (2013.01)

(58) Field of Classification Search
CPC ..... A47L 9/02
USPC ..... 15/416
IPC ..... A47L 9/02
See application file for complete search history.

(56) References Cited

U.S. PATENT DOCUMENTS

| | | | |
|---|---|---|---|
| 5,502,870 | A | 4/1996 | Ragner et al. |
| 5,504,970 | A | 4/1996 | Neshat et al. |
| 6,536,076 | B2 | 3/2003 | Scian et al. |
| 6,991,262 | B1 | 1/2006 | Ragner |
| 7,257,852 | B2 | 8/2007 | Shibuya et al. |
| 2009/0158551 | A1 | 6/2009 | Varichon et al. |

FOREIGN PATENT DOCUMENTS

| | | | |
|---|---|---|---|
| DE | 1173623 | B | 7/1964 |

*Primary Examiner* — David Redding
(74) *Attorney, Agent, or Firm* — Gifford, Krass, Sprinkle, Anderson & Citkowski, P.C.

(57) ABSTRACT

An attachment for an upright vacuum cleaner which can be pivoted from a first position for cleaning a wide area to a position providing a nozzle which is capable of reaching narrow areas to permit cleaning in corners and around obstacles.

1 Claim, 2 Drawing Sheets

VACUUM EXTENSION

CROSS-REFERENCE TO RELATED APPLICATIONS

This application claims priority of U.S. Provisional Patent Application Ser. No. 61/638,575, filed Apr. 26, 2012, which is incorporated herein by reference.

FIELD OF THE INVENTION

The present invention is directed to a nozzle attachment for vacuum cleaners and the like having an extension pivotally mounted to a nozzle head which is pivotal from a position in which a wide path of a rug or the like can be cleaned to a position which enables difficult places to be reached for cleaning.

BACKGROUND OF THE INVENTION

Conventional vacuum cleaner nozzles are not configured to clean in corners or around obstacles such as chair legs or table legs. Generally each time an obstacle or a corner is encountered the nozzle attachment being used must be replaced with another nozzle configured to reach tight places. The present invention provides an attachment which when it is in its normal position can be used for normal cleaning. When a corner or other obstacle is encountered the attachment head of the nozzle can be pivoted to a position which provides a second nozzle capable of cleaning in corners or around obstacles.

SUMMARY OF THE INVENTION

Conventional vacuum cleaners are provided with separate nozzles for cleaning in corners and around obstacles such as chairs and other furniture. When a tight place is encountered while using a conventional vacuum cleaner the vacuum cleaner must be turned off to replace the nozzle that is being used with a nozzle with a profile for reaching hard to reach spots such as a corner or around the legs of tables and chairs. With the new nozzle in place the vacuum cleaner is again turned on, When the corner is cleaned the vacuum cleaner again needs to be turned off to replace the nozzle with the original nozzle before cleaning can be resumed The attachment of the present invention can be converted from a nozzle for use with ordinary cleaning to a nozzle for tight places such as corners or around furniture by simply pivoting the extension of the attachment from one position to another, This can be accomplished without the necessity of shutting the equipment down.

DETAILED DESCRIPTION OF THE PREFERRED EMBODIMENTS

Figures 1, 2, 3:
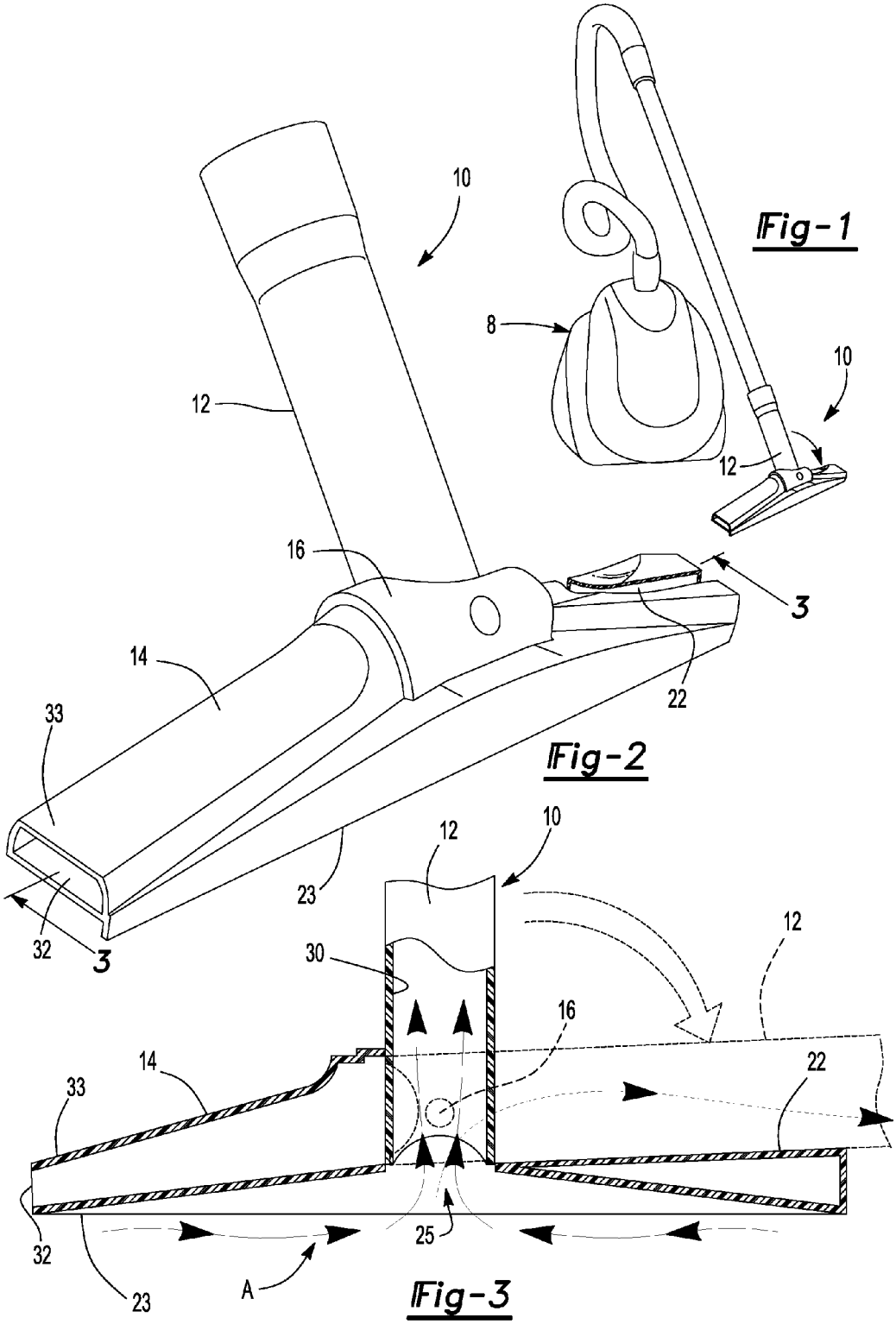
FIG. 1 is an isometric view of the vacuum nozzle attachment of the present invention shown attached to an upright vacuum cleaner and in a first pivoted position.
FIG. 2 is an enlarged view of the attachment shown in FIG. 1.
FIG. 3 is a cross sectional view as seen from lines 3-3 of FIG. 2.

As can be seen in FIG. 1 the nozzle attachment 10 of the present invention includes a nozzle head 14 and a tubular extension 12 pivotally mounted to the nozzle head 14 by a socket 16. The opposite end of the extension 12 is adapted to be attached to a vacuum cleaner 8.

As best seen in the views of FIGS. 1 and 3 the socket 16 connection between the extension 12 and the nozzle head 14 permits the extension 12 to be pivoted, as shown by the arrows in FIG. 3, from a first upright position shown in FIG. 2 to a pivoted position best seen in FIG. 3. In the pivoted position shown in FIG. 2 the extension 12 fits within a cradle 22 formed in the nozzle head 14.

Still referring to FIG. 3 the nozzle head 14 is formed with a lower flat surface 23 adapted to engage a surface to be cleaned when the nozzle attachment 10 is in use as shown in FIGS. 1-3. As best seen in FIG. 3 the open bottom lower surface 23 of the nozzle head 14 is connected with the interior 30 of the tubular extension 12 so that vacuum applied to the extension 12 is used to clean a floor through the nozzle openings 25 when a floor or similar surface is cleaned with the nozzle attachment 10 in the position shown in FIGS. 1-3.

Figure 4:
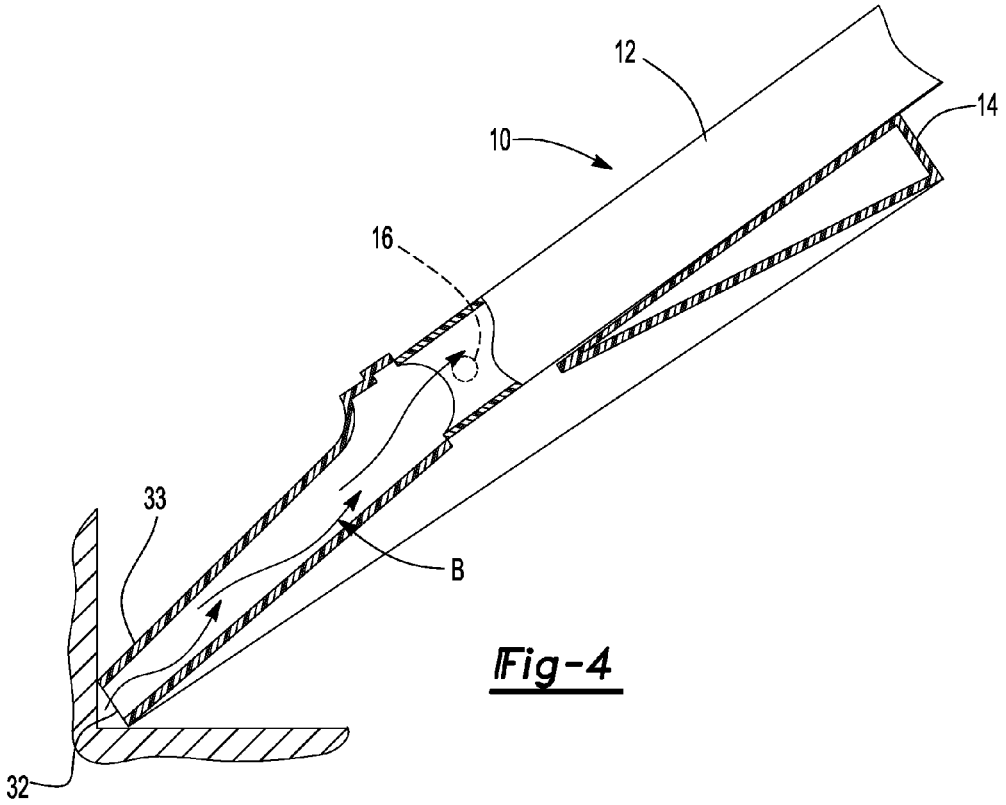
FIG. 4 is a longitudinal cross sectional view of the vacuum nozzle attachment shown in a second pivoted position.

Still referring to FIG. 3 the nozzle head 14 is provided with an opening 32 on one end 33 of the nozzle head 14 opposite the cradle 22 so that with the extension 12 pivoted into the cradle 22 as shown in phantom in FIG. 3 and in solid lines in FIG. 4 the end 33 the nozzle head 14, in effect, provides a nozzle at the opening 32 positioned to provide vacuum to a small surface to be cleaned. The portion of the nozzle head 14 presented to the surface to be cleaned with extension 12 pivoted to the position shown in FIG. 4 is much smaller than the portion of the nozzle head 14 positioned for normal cleaning as shown of FIG. 2 thereby providing a nozzle which can be used to clean around obstacles and in corners and other hard to reach places.

With the nozzle attachment 10 of the present invention attached to the vacuum cleaner 8 and with the extension 12 and the nozzle head 14 in the position shown in the FIGS. 1 and 2 nozzle head 14 is in a position to permit a wide swath of the surface to be cleaned. When a corner or other hard to reach area is encountered it is not necessary to turn the vacuum cleaner 8 off. It is only necessary to reach down and pivot the extension 12 to the position shown in phantom in FIG. 3. The nozzle head 14 is then in a position to use the end 33 to clean around obstacles or hard to reach places.

Figure 5:
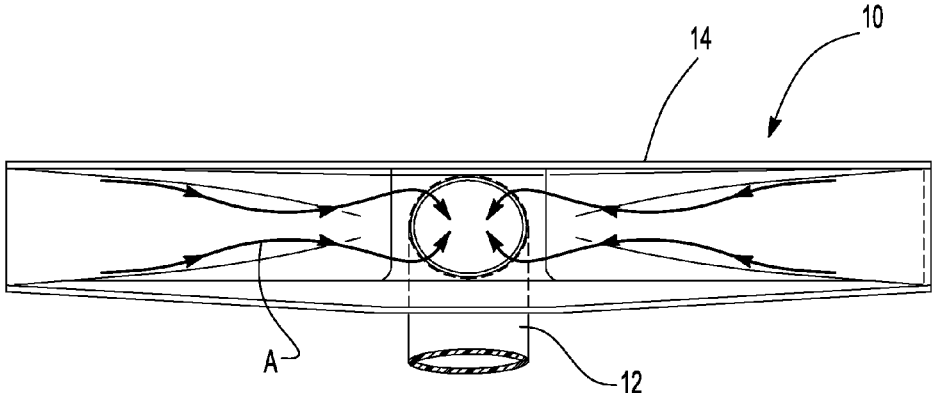
FIG. 5 is a view as seen from the bottom of FIG. 3.

As can best be seen in FIG. 5 with the nozzle head 14 in the position shown in FIGS. 1 and 2 a path A is opened from the area beneath the nozzle head 14 to the interior of extension 12 to the vacuum cleaner 8. With the extension 12 pivoted to the position shown in FIG. 4 the path A from beneath the nozzle head 14 to the extension 12 is closed and a path B is opened from the end 32 to the interior of the extension 12.

It is to be appreciated that the description and the drawings are provided for illustrative purposes only. Thus, one skilled in the art would know to make modifications, adjustments and the like to the described embodiment and still be within the scope of the present invention. As such the scope of the invention is not defined by the description and figures, but by the claims below.

What is claimed is:

1. A nozzle for attachment to a tubular inlet of a vacuum cleaner, said attachment comprising;

a nozzle head having a first elongated opening providing a wide exposure to a surface to be cleaned in a first position and a second opening providing a smaller area of exposure to the surface to be cleaned in a second position;

said nozzle head having an elongated shape and having a top surface, a bottom, and an end formed between the top surface and the bottom of the nozzle head;

a tubular connector extending from the top of said nozzle head when said nozzle is in the first position and providing a straight line path between said bottom of said head and the tubular inlet of the vacuum cleaner;

said nozzle attachment having an elongated cradle formed in the top surface of the attachment and said tubular connector being pivoted and rotable to be positioned in said cradle in said second position to enable said second opening to be used to clean a surface;

said tubular connector in said cradle providing a straight line path between said second opening and the tubular inlet of the vacuum cleaner.

* * * * *